US005379898A

United States Patent [19]

Joulia

[11] Patent Number: 5,379,898

[45] Date of Patent: Jan. 10, 1995

[54] SELF-BREAKABLE AMPOULE

[75] Inventor: Gérard Joulia, Paris, France

[73] Assignee: L'Oreal, Paris, France

[21] Appl. No.: 117,100

[22] PCT Filed: Dec. 17, 1992

[86] PCT No.: PCT/FR92/01196

§ 371 Date: Sep. 14, 1993

§ 102(e) Date: Sep. 14, 1993

[87] PCT Pub. No.: WO93/15707

PCT Pub. Date: Aug. 19, 1993

[30] Foreign Application Priority Data

Feb. 6, 1992 [FR] France ..... 92 01347

[51] Int. Cl.[6] ..... B65D 1/02; A61J 1/06

[52] U.S. Cl. ..... 206/528; 215/32; 215/246

[58] Field of Search ..... 215/32, 246; 206/528, 206/530, 532

[56] References Cited

U.S. PATENT DOCUMENTS 4,826,025 5/1989 Abiko et al. ..... 215/32

4,964,521 10/1990 Wieland et al. ..... 215/32

FOREIGN PATENT DOCUMENTS 0133314 2/1985 European Pat. Off. .

0269003 6/1988 European Pat. Off. .

941772 1/1949 France .

572176 9/1945 United Kingdom .

*Primary Examiner*—Allan N. Shoap

*Assistant Examiner*—Nova Stucker

*Attorney, Agent, or Firm*—Young & Thompson

[57] ABSTRACT

Self-breakable ampoule (1) of the "bottle" type allowing for the easy flow of the product contained in the ampoule. The neck zone (4) of the ampoule is covered at the prebreaking line (7) by a sleeve (10) of plastic material (preferably heat-shrinking plastic) comprising an extension projecting beyond the prebreaking line (7) in the form of a tongue or collar after breakage of the ampoule along the line (7). This extension (10*a*) has a length d (measured as a projection over the axis of the neck zone) at least equal to 20% of the diameter of the orifice obtained after breakage of the ampoule along the line (7), the plane tangential to the surface forming the extension (10*b*) in the vicinity of the line (7) forming an angle of less than 60° with the axis X—X.

8 Claims, 1 Drawing Sheet

SELF-BREAKABLE AMPOULE

FIELD OF THE INVENTION

This invention relates to a self-breakable ampoule allowing for easy flow of the product contained in the ampoule.

BACKGROUND OF THE INVENTION

As is known, self-breakable ampoules are glass ampoules comprising a pre-breaking line in the vicinity of at least one of their ends in a neck zone having a smaller diameter than that of the body of the ampoule, so that the user can break the ampoule without a file by exerting simple lateral pressure on the ampoule with his fingers on either side of the prebreaking line. This prebreaking line can be obtained by numerous processes, such as filing, localized enamelling of the glass, localized heating or the like.

The diameter at the prebreaking line is limited by the possibility of breaking the ampoule manually. In practice, this diameter cannot exceed approximately 8 mm. Under these conditions, it is not possible to obtain an opening allowing for the free flow of the product as in the case of a bottle. Consequently, the flow of the liquid product contained in the ampoules is often a problem and the user has to shake the ampoule vigorously in order to empty it.

In order to improve the flow of the product, it is known to open the ampoule at both ends. However, this process limits the shapes that can be used for the ampoule as the ampoule must comprise two necks or two tips. In addition, the entire dose of product contained in the ampoule must all be used at once.

It has also been proposed to slip a small dispensing nipple of flexible material over the neck zone after breakage, this nipple having the shape of the finger of a glove and being provided at its end with a .small dispensing orifice. By pressing repeatedly on this nipple, it serves as a pump and allows for dispensing of the product. However, this nipple is relatively expensive and the boxes of ampoules therefore comprise only one single nipple. This can be lost easily and the product contained in the remaining ampoules can then no longer be dispensed in a simple manner.

It is therefore desired to produce self-breakable ampoules of the "bottle" type which are opened at only one end, so that they can be given many different shapes, and from which the product can still flow freely, so that the entire dose contained in the ampoule does not all have to be used at once. Moreover, it is desired to avoid the addition of a nipple once the ampoule has been opened.

Moreover, it is known from FR-A 2 512 784 to apply a polymer covering having a thickness of several tenths of a millimeter to the prebreaking line by spraying or coating, in order to prevent the user from being injured by any glass splinters produced when the ampoule is broken. However, a covering of this kind applied only over the prebreaking ring does not allow for any improvement in the dispensing of the liquid product contained in the ampoule.

SUMMARY OF THE INVENTION

According to this invention, it has been found that the problem of the flow of the product can be solved by fitting a plastic sleeve over the neck zone of the ampoule at the prebreaking line, said sleeve, after breakage and removal of the broken end, forming an extension of the neck zone projecting beyond the broken edge of the ampoule.

Therefore, this invention relates to a self-breakable ampoule the body of which contains a liquid product and which is provided in the vicinity of one of its ends with a neck zone of revolution about an axis, a prebreaking line being formed on the neck zone, characterized in that the neck zone is covered at the prebreaking line by a sleeve of plastic material projecting over at least an angular sector beyond the prebreaking line on the side opposite the body, thereby forming an extension, the projection of which over the axis has a length at least equal to 20% of the diameter of the orifice defined after breakage of the ampoule along the prebreaking line by the edge of the part of the neck still attached to the body, the plane tangential to the surface forming the extension in the vicinity of the prebreaking line forming an angle alpha of less than 60° with the axis of the neck zone. The angle alpha is preferably between 40° and 50°.

According to the invention, the plastic sleeve is preferably made of heat-shrinking plastic material. In this manner, the plastic sleeve is closely matched to the shape of the neck zone of the ampoule by simple heating. The heat-shrinking plastic material can consist in the known manner of a polyolefin, a fluoroplastic such as polyvinylidene fluoride or tetrafluoroethylene, elastomers such as fluoelastomers and silicones having shrinking temperatures of approximately 90° to 100° C. The heat-shrinking sleeve preferably has a thickness of between 0.04 and 0.5 mm.

The extension is preferably formed all around the axis of the neck zone over an angular sector of 360°. The free edge of the extension is advantageously substantially in a plane perpendicular to the axis of the neck. The plastic sleeve can be of any length on the side opposite the extension. In particular, it can cover the greater part of the ampoule and can serve as a label.

It has been noted that the presence of the extension on the edge of the neck allows for flow of the product, while there is no flow in the absence of the extension. This phenomenon is unexplained and it is likely that it depends on several parameters. This phenomenon could be partly due, e.g. to the differing wettability of the glass and the plastic material. It may also be supposed that it is partly due to a cavitation effect caused by the recess between the glass wall and the plastic wall corresponding to the thickness of the glass.

The presence of the extension on the ampoule according to the invention also has the advantage of preventing the formation of glass splinters when the end of the ampoule is broken. Moreover, the presence of the extension prevents the user from injuring himself on the edge of the neck after breakage.

BRIEF DESCRIPTION OF THE DRAWINGS

The invention will be more readily understood from the following description of one embodiment of the invention given purely by way of a non-limiting example and with reference to the accompanying drawings, in which.

DETAILED DESCRIPTION OF THE INVENTION

Figure 1:
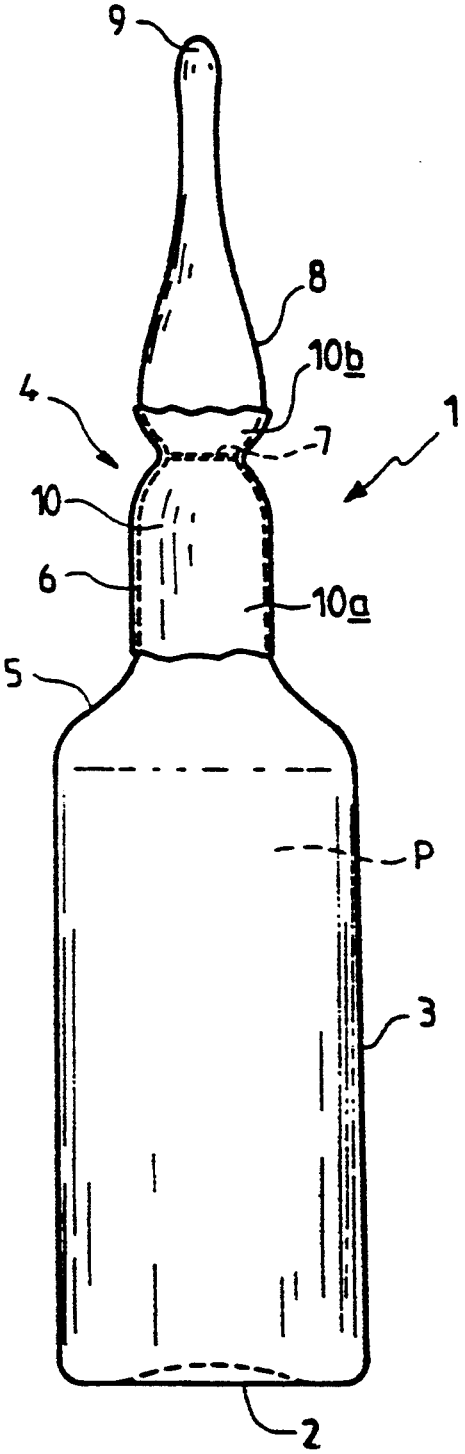
FIG. 1 is a side view of an ampoule according to the invention before breakage.

The ampoule shown in FIG. 1 is a glass ampoule of the "bottle" type which is designated in its entirety by the reference numeral 1. The ampoule 1 is an ampoule of revolution about a longitudinal axis X—X. It comprises a cylindrical body 3 containing a liquid product P. The body 3 is closed at one of its ends along the axis X—X by a concave base 2. The other end is formed by a neck zone 4 having a smaller diameter than that of the body 3 and connected to the latter by a shoulder 5.

The neck zone 4 is formed by a cylindrical part 6 connected to an annular zone having a smaller diameter than the cylindrical part 6 on which a prebreaking line 7 is formed, e.g. by filing. On the side opposite the part 6, the annular zone is connected to a bulb 8, the tip 9 of which is closed by welding once the body 3 of the ampoule has been filled.

A sleeve 10 of heat-shrinking plastic material surrounds the cylindrical part 6 of the neck, the annular zone on which the prebreaking line 7 is engraved and a part of the bulb 8. This plastic sleeve is placed over the neck zone 4, by placing a cylindrical tube portion consisting of a heat-shrinking polyester film having a thickness of 0.04 mm over the shoulder 5 and heating it to 90° C. so as to form a sleeve 10 which fits closely over the neck zone 4 without gluing.

The outer diameter of the neck zone 4 at the prebreaking line 7 is 6 mm and the distance d (measured as a projection over the axis X—X) between the prebreaking line 7 and the edge of the sleeve 10 over the bulb 8 is approximately 2 mm. The thickness e of the glass forming the ampoule is approximately 0.7 mm. The viscosity of the product P is 45 centipoises and its surface tension is 30 Dyn/cm.

Figure 2:
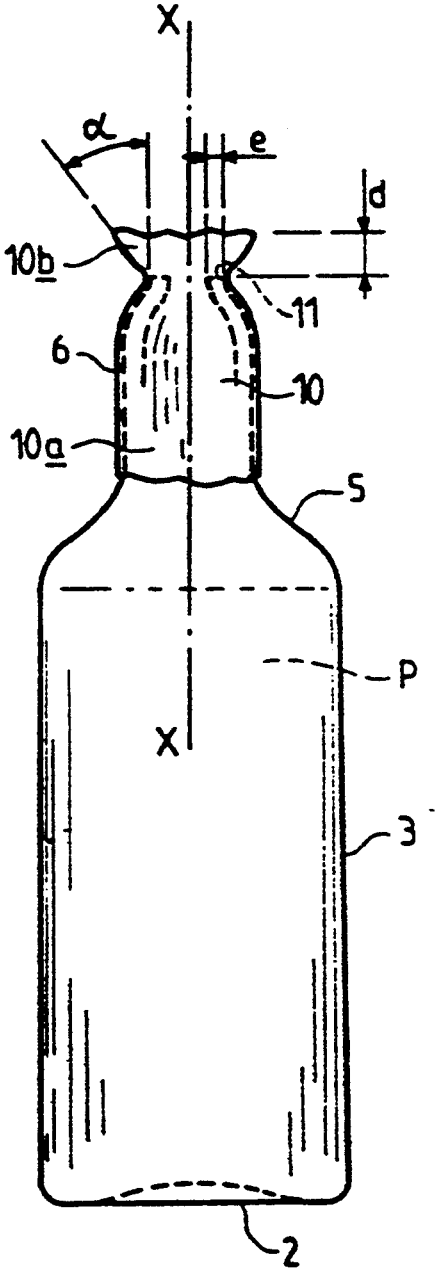
FIG. 2 shows the same ampoule after breakage.

When the user wishes to remove the product P contained in the body 3 of the ampoule, he presses laterally with his fingers on the neck zone 4 on either side of the prebreaking line 7 until breakage of the neck along the prebreaking line 7. The user then removes the bulb 8 which separates from the sleeve 10. As can be seen in FIG. 2, one part 10*a* of the cylindrical sleeve remains fixed to the cylindrical part 6 of the neck zone 4 and one part 10*b* is freed. This part 10*b* forms a truncated extension having an angle alpha 45° relative to the tip which forms a sort of inverted funnel diverging at the outlet of the ampoule.

The user then inclines the ampoule 1 so that the product P contained in the body 3 flows. As it flows, the product is first in contact with the glass wall of the cylindrical part 6 of the neck zone 4 and then with the plastic of the inner wall of the extension 10*b* of the sleeve. As it passes, it traverses a recess 11 corresponding to the thickness of the glass at the prebreaking line 7. It will be noted that the product P flows easily without the ampoule 1 having to be shaken.

I claim:

1. In a self-breakable ampoule comprising a body which contains a liquid product and which is provided in the vicinity of one of its ends with a neck zone surrounding an axis, and a prebreaking line formed on said neck zone, the improvement wherein said neck zone is covered at the prebreaking line by a sleeve of plastic material projecting over at least an angular sector beyond the prebreaking line on a side opposite the body, thereby forming an extension, said extension projecting alongside said axis by a length at least equal to 20% of the diameter of the orifice defined after breakage of the ampoule along the prebreaking line, wherein an edge of a portion of the neck zone remains attached to the body, and a plane tangential to the extension in the vicinity of the prebreaking line forms an angle $\alpha$ between 40° and 60° with said axis, and whereby after said breakage, said extension forms a radially outwardly flaring spout.

2. Ampoule according to claim 10, wherein the angle $\alpha$ is between 40° and 50°.

3. Ampoule according to claim 1, wherein the sleeve is made of heat-shrinking plastic material.

4. Ampoule according to claim 1, wherein the sleeve has a wall thickness between 0.04 and 0.5 mm.

5. Ampoule according to claim 1, wherein the neck zone is formed by a substantially cylindrical part and a closed bulb, said cylindrical part and said closed bulb being connected together by an annular zone of a smaller diameter on which the prebreaking line is formed.

6. Ampoule according to claim 1, wherein the length of the sleeve on the side opposite the extension is such that it covers the greater part of the neck zone situated between the body and the prebreaking line.

7. Ampoule according to claim 1, wherein the extension is formed all around the axis over an angular sector of 360°.

8. Ampoule according to claim 7, wherein the extension has a free edge which is in a plane substantially perpendicular to said axis.

* * * * *